US006910222B1

(12) United States Patent
Schssler

(10) Patent No.: US 6,910,222 B1
(45) Date of Patent: Jun. 28, 2005

(54) TEXTILE GARMENT HAVING REPLACEABLE ELEMENTS OF INDIVIDUAL MATERIAL

(76) Inventor: Leander Schssler, Stettiner Strasse 4, D-63843 Niedernberg (DE)

( * ) Notice: Subject to any disclaimer, the term of this patent is extended or adjusted under 35 U.S.C. 154(b) by 0 days.

(21) Appl. No.: 09/913,209

(22) PCT Filed: Feb. 5, 2000

(86) PCT No.: PCT/DE00/00399

§ 371 (c)(1),
(2), (4) Date: Aug. 16, 2001

(87) PCT Pub. No.: WO00/47069

PCT Pub. Date: Aug. 17, 2000

(30) Foreign Application Priority Data

Feb. 10, 1999 (DE) ..... 199 05 369
Jul. 19, 1999 (DE) ..... 199 33 072

(51) Int. Cl.[7] ..... A41B 1/08
(52) U.S. Cl. ..... 2/69; 2/244
(58) Field of Search ..... 2/115, 244, 69, 2/106, 48

(56) References Cited

U.S. PATENT DOCUMENTS 3,319,260 A * 5/1967 Cummins ..... 2/458
3,991,420 A * 11/1976 Savarino ..... 2/462
5,742,939 A * 4/1998 Williams ..... 2/69
6,041,436 A * 3/2000 Keen ..... 2/69

* cited by examiner

*Primary Examiner*—Danny Worrell
(74) *Attorney, Agent, or Firm*—Edwin D. Schindler

(57) ABSTRACT

A textile includes a plurality of individual elements of material with each of the plurality of individual elements having a given shape, with the given shape of one of the individual elements being either the same or different from one or more other individual elements. A plurality of segments of material are placed on at least one of the individual elements with adjacent segments of the plurality of segments being formed with complementary shapes to one another. The plurality of segments are able to be connected to at least one of the individual elements in either a non-detachable or detachable manner.

21 Claims, 3 Drawing Sheets

TEXTILE GARMENT HAVING REPLACEABLE ELEMENTS OF INDIVIDUAL MATERIAL

BACKGROUND OF THE INVENTION

1 Technical Field of the Invention

Figure 1:
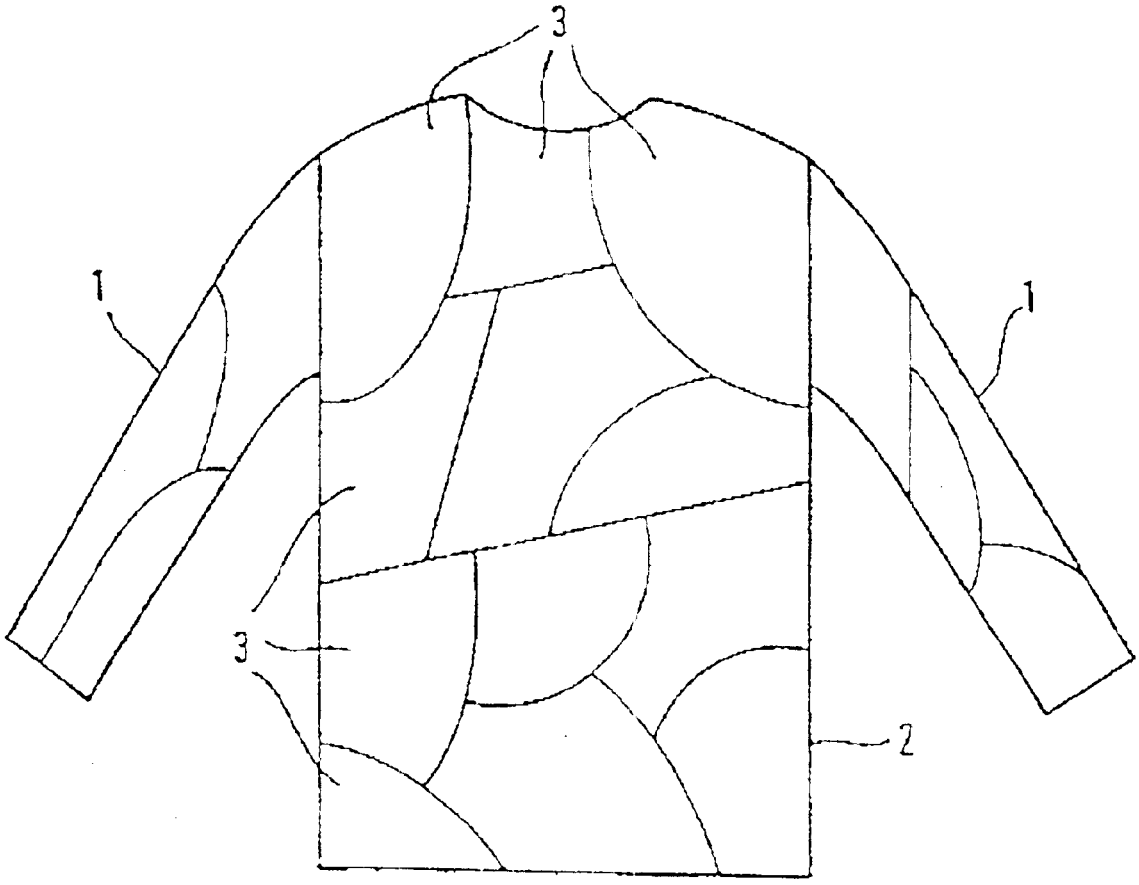

The invention relates to a textile comprised of one or more elements, wherein individual elements consist of materials and/or tissues having a given cut and the adjacent elements are connected to each other by their edges, and a method for producing the textiles according to the invention.

By the term textiles is meant all woven, machine or hand knitted goods or products produced from fibre materials, in which the fibres may be natural and/or synthetic. This term includes, inter alia, clothing articles, blankets, carpets and tapestries. Textiles may consist of a multiplicity of elements, in particular clothing articles from the field of outer clothing, in particular jackets, coats, shirts, blouses or pullovers are to be mentioned, which may consist of, for example, sleeves, collars, cuffs, clothing fronts and backs, and the like, it being in principle conceivable for individual elements not to consist of textile material, but of leather and the like. By the connection of a plurality of material or tissue cuts or elements by their edges, the textiles can be provided with the three-dimensiotal shame of a clothing article. Such clothing articles can furthermore be additionally provided with buttons, zip fasteners or the like. A further embodiment of the textiles consists in the material and/or tissue cuts being made up into blankets, tapestries or carpets. The design of textiles, as regards the shave, colour patterning or cut pattern, is almost entirely freely variable.

Clothing articles are known in which, for example, the sleeves or the hoods are fastened by means of zip fasteners or press studs to the rest of, the clothing article. By virtue of the removability of individual elements of a clothing article, the functionality is increased, since it can be adapted to various needs.

2 Description of the Prior Art

A disadvantage of textiles of the prior art consists in the fact that when one element of the textile is damaged, e.g. by tearing of the fabric on a sharp object, the utility value of the textile is greatly reduced. Although the damaged article can be repaired again, usually by sewing, darning or the like, the aesthetic exterior of the textile is often considerably depreciated. In addition, for example, clothing articles are offered for sale only in the final state, and the purchaser or user has hardly any opportunity to vary the form or appearance of the clothing article. Furthermore, a conventional textile can be virtually no longer altered in its external appearance and, particularly in the case of clothing articles, the application of a decoration is only possible by sewing or ironing on.

SUMMARY OF THE INVENTION

The object of the invention is to provide a textile with which, after damage of an element, a repair is possible, and whose exterior can be changed in colour or material at least by sections, without impairing the functionality of the textile, and a production process in which the customer or user himself undertakes the composition of the textile, and can thus exert influence on the shape of the textile.

This object is achieved by the invention in that the individual elements are segmented or segments are placed at least by sections on a single piece element, the adjacent segments are connected either detachably or non-detachably to each other or to the element.

The gist of the inventions consists in the fact that the elements forming the textile are segmented or that individual segments are placed at least by sections on a single-piece element. Here, the term "segmented" means that the elements are dismembered or divided into individual sections or portions. The adjacent segments in turn are detachably or non-detachably connected to each other by their edges or fastened abutting each other on an element. The type of connection of the elements and/or segments to each another is unimportant according to the invention, but, as described below, may be carried out by sewing or by means of a zip fastener connection. That means, for example, that the sleeve of a pullover consists of several segments, and not, as in the prior art, of a single cut. If an individual segment is then damaged by external effects, only this individual segment need be exchanged to restore the utility value of the textile. Or the clothing article is designed such that a portion or, for example, the front is covered with various segments, which are exchangeable, and thereby the appearance is variable, as described below. Furthermore, such a textile may offer considerably purchase incentive on account of its novelty, which is particularly important in view of continually changing clothing fashions.

Advantageous embodiments of the invention are the subject of subclaims.

An advantageous embodiment of the textile, particularly when it is a clothing article, consists in the fact that it has a single-piece lining. In the case of clothing articles, this lining already has the subsequent form of the complete clothing article. On this lining are fastened the individual segments. Here, too, the type of fastening is insignificant according to the invention and may be detachable or non-detachable. By virtue of the connection of the segments to the lining and of adjacent segments to each other, the clothing article obtains its ultimate form. Such a lining simplifies the joining together of individual segments, since the subsequent form of the clothing article is determined by the lining.

The textile can be embodied such that the textile forms the lining of another textile. In particular, it is intended that this should be a conventional, that is to say unsegmented clothing article which is provided with a segmented lining. Here, too, the lining may be detachably or non-detachably connected to the clothing article, with any type of connection being possible. This segmented lining may be used, for example, in children's clothing, with the clothing article being provided with the lining by the children themselves. The fact that the outer form is already determined by the clothing article greatly simplifies the lining of the clothing article with the individual segments of the lining.

By means of a non-detachable connection of the segments to each other, which may take place by, for example, edge sewing and/or adhesive bonding with appropriate adhesives, textiles are produced whose segments cannot be detached from each other, especially not unintentionally. Such textiles are, after connection of the elements to each other, virtually equivalent to textiles of the prior art, in which the elements are virtually non-detachably connected to each other. This is particularly important in the case of clothing articles for children, since this prevents an unintentional or wilful separation of the clothing article.

A detachable connection of the individual segments and/or elements to each other may take place in several ways. It is possible for zip fasteners to be attached to the edges of the individual segments. Furthermore, hook-and-loop fasteners or press-studs attached to the edges are conceivable. The advantages of a detachable connection of the individual segments to each other consists in the fact that individual segments, e.g. damaged segments can be readily replaced. In addition, the clothing article which can be assembled and taken apart as often as desired, is thereby given a novel appearance, which may be of advantage for the sale of such clothing articles in the fashion industry, which is always looking out for novelties. Furthermore, particularly in the case of a clothing article, the functionality can be adapted to particular needs. It is possible, e.g., to detach the arms of a jacket or to turn a pullover into a slipover.

A possible embodiment of the textile consists in the edges of the elements, at least at the seams and/or waistband and/or edges, not being segmented. This has the advantage that the continuous edges of the elements, which are connected to adjacent elements, form a shape-providing skeleton or framework for the segments to be inserted. In the case of clothing articles, for example, the continuous edges, which are to be connected together, of the elements already determine the subsequent form of the clothing articles.

If the textile is designed such that the individual segments differ in shape, site, pattern or colour, an increase in the functionality and aesthetics of the textile can be obtained. Thus, in the case of clothing articles, e.g. a more resistant material can be used at particularly stressed areas, e.g. in the elbow region in the case of jackets, or a particularly breathable material in the armpit area. Such an embodiment of the textile also has the advantage that, by virtue of the freedom of shaping of the segments, a clothing article can be dimensionally accurately adapted to the wearer, since, by virtue of the segmentation of the elements, a substantially more accurate adaptation of the clothing article to the wearer is possible. The freedom of colouring or patterning allows the textile to be given virtually any desired appearance. In particular in the case of segments placed on a single-piece element, it is proposed that segments with different colouring or patterning but in each case with the same shape are exchangeable for each other, in order to represent various motifs, such as, inter alia, comic figures, logos, club badges, etc., on, for example, the front or back of a clothing article by the exchange of segments.

For fastening the segments on a single-piece element, a detachable or non-detachable connection is possible. In particular the use of hook-and-loop fasteners is proposed, since it allows simple and virtually unrestrictedly repeatable detachment of the elements. Advantageously, they are designed such as to determine the individual segments, in each case at their edges, on the element, that is to say the hook-and-loop fasteners form a continuous network-like structure, and the segments themselves are not connected to each other. Thus segments of, e.g., different colours can be placed in order to allow variation of the appearance of the textile and particularly of an article of clothing. In the case of children's clothing advantageously only one part of the front side is covered with segments in order to prevent unnoticed removal and/or theft at the back.

For the shaping of the segments placed on a single-piece element, it is proposed that they are complementary to each other at their edges, i.e. can be uniquely assigned to each other in the manner of a jiasaw puzzle. They can only be put together in specific way to form a generally closed area on the element. Thus a further element oa diversion is provided for the use of a textile, which is particularly of interest in the case of children's clothing. It is also conceivable to cover a blanket or carpet with jigsaw-puzzle-like elements to obtain a novel toy, for example, for children.

The segments can be distanced from each other on a single-piece element. In this case, each individual segment is detachably fastened on the element, for example, by means of a hook-and-loop fasteners surrounding the edge of the segment. The choice of motif for each individual segment is free and may be selected from, inter alia, various animal pictures, comic figures, brand name logos or pictures of persons.

The production of a clothing article according to the invention may be carried but by the process indicated here. In this case, the individual segments of the textile are loosely packaged and offered for sale by the manufacturer. That means that although the individual segments are separate from each other, they can nevertheless be sold as an entirety. The task of the purchaser or user of the textile consists in himself connecting these segments together, and producing the desired textile, that is to say usually a clothing article, from them. In the process the individual segments are first connected to each other and the elements formed therefrom are then combined to form the final textile. The type of connection, whether detachable or non-detachable, depends on the intended use of the particular textile. In the case of a detachable connection of the segments, the latter are already provided with devices for connecting the elements, for example the zip fasteners.

BRIEF DESCRIPTION OF THE DRAWING FIGURES

Figure 2:
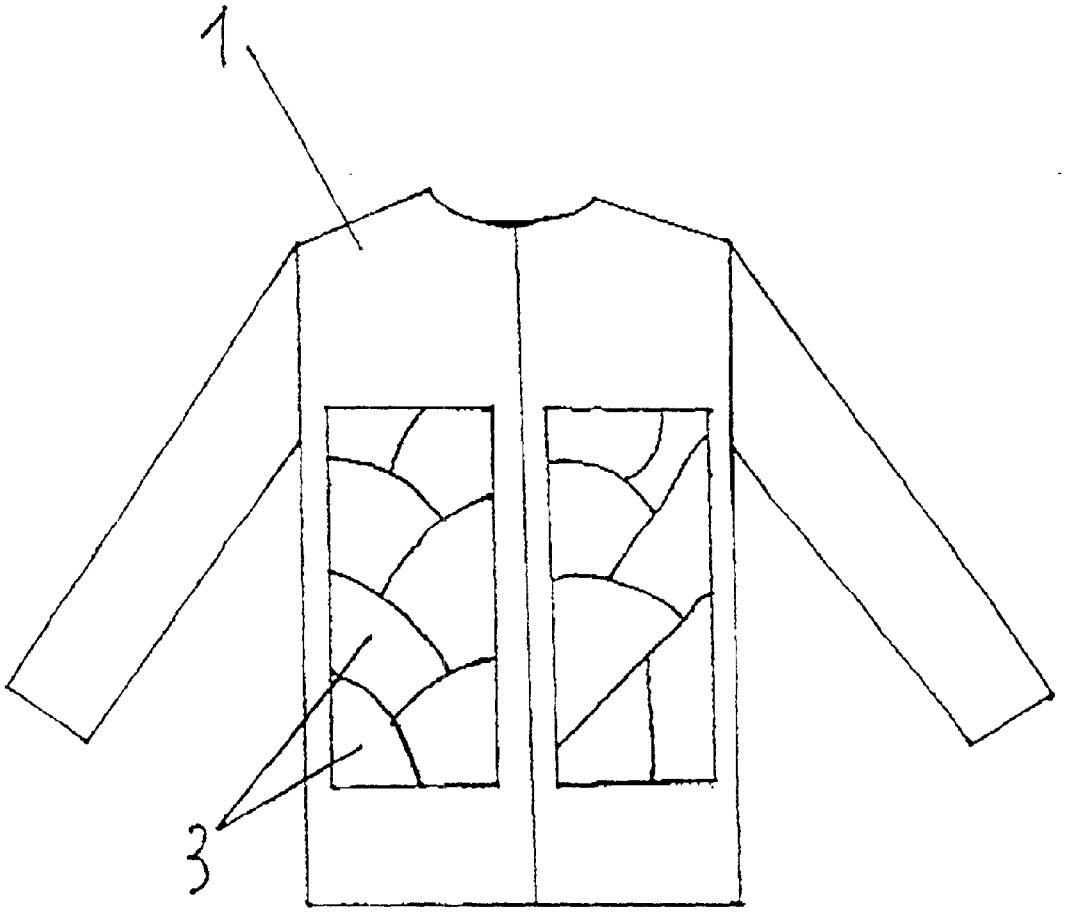
Figure 3:
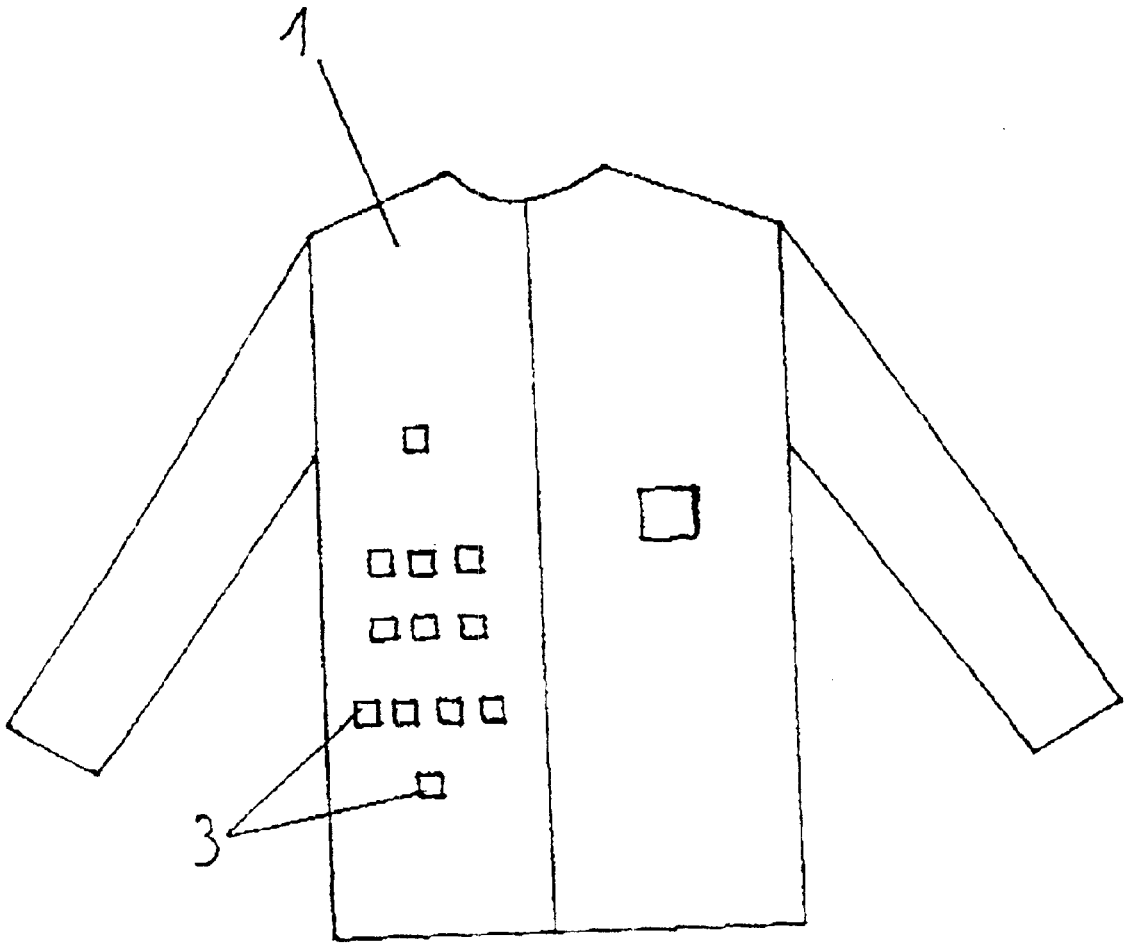

Further details, features and advantages of the invention can be obtained from the following descriptive part, wherein with reference to the drawings and typical embodiments of the invention, FIG. 1 shows a schematic view of a clothing article according to the invention, FIG. 2 shows a clothing article which is partly covered with segments, FIG. 3 shows a clothing article that is covered with segments distanced from each other.

DETAILED DESCRIPTION OF THE DRAWING FIGURES

The clothing article shown in FIG. 1 is a pullover with sleeves and a front portion. In the drawing, it can be recognised how each element of the pullover, that is to say the sleeves (1) and the front (2), is segmented. Each individual element of the clothing article, e.g. the front portion (2) is composed of a plurality of segments (3), which in this embodiment all differ in their size and shape. The segmented elements (1, 2) are assembled to form the complete clothing article. The type of connection between adjacent segments or elements is in this typical embodiment free in order to simplify the drawing, but may take place by, for example, sewing the individual segments to each other at their edges.

FIG. 2 shows the front portion of a clothing article, for example a jacket, wherein segments (3) placed on an element (1) of the jacket front portion on only one part of the area, e.g. the breast area. The detachable fastening may be carried out by means of hook-and-loop fasteners surrounding the edge of a segment (3). The colour and shape and the material of the individual segment (3) is unimportant according to the invention. The functionality, e.g. protection against moisture, is not affected by the segments (3), they are only decorative elements. By exchange of the segments (3) for others or a different colour, various motifs can be formed on the clothing article.

FIG. 3 also shows the front portion of a clothing article, for example a jacket. This has segments (3) distanced from each other placed on a portion of its front. The detachable fastening may take place, for example, by means of a hook-and-loop fastener surrounding the edge of the segment (3), and each segment (3) is exchangeable independently of the others. The placing of the individual segments may take place such as to imitate the constellation of a football team with its trainer. The individual segments (3) are then provided with illustrations of the particular players. On the other side, the club badge can then be attached. It would also be conceivable for representations of music groups or artists or works of art per se to be reproduced on the segments (3).

What is claimed is:

1. A textile garment, comprising:

a plurality of individual elements of textile material with each of said plurality of individual elements having a given shape, said given shape of one of said individual elements being either the same or different from one or more other said individual elements;

a plurality of segments of textile material being placed on at least one of said individual elements of said plurality of individual elements, with adjacent segments of said plurality of segments being formed with complementary shapes, and placed contiguously, to one another;

means for connecting said plurality of segments to at least one of said individual elements of said plurality of individual element; and, means for connecting individual elements to one another at their edges.

2. The textile garment according to claim 1, further comprising a single-piece lining with said plurality of segments being fastened to said single-piece lining.

3. The textile garment according to claim 2, wherein said plurality of segments are detachably fastened to said single-piece lining.

4. The textile garment according to claim 2, wherein said plurality of segments are non-detachably fastened to said single-piece lining.

5. The textile garment according to claim 1, wherein adjacent said individual segments are connected to one another via edges of said adjacent individual segments.

6. The textile garment according to claim 5, wherein said edges of adjacent individual segments are not segmented at seams or waistbands.

7. The textile garment according to claim 1, wherein individual segments of said plurality of segments have different shapes from one another.

8. The textile garment according to claim 1, wherein individual segments of said plurality of segments have different sizes from one another.

9. The textile garment according to claim 1, wherein individual segments of said plurality of segments have different patterns from one another.

10. The textile garment according to claim 1, wherein individual segments of said plurality of segments are made of different materials from one another.

11. The textile garment according to claim 1, wherein individual segments of said plurality of segments have different shapes from one another.

12. The textile garment according to claim 1, wherein said means for connecting said plurality of segments to at least one of said individual elements is means for detachably connecting said plurality of segments.

13. The textile garment according to claim 12, wherein said means for detachably connecting said plurality of segments is a plurality of hook-and-loop fasteners.

14. The textile garment according to claim 1, wherein said means for connecting said plurality of segments to at least one of said individual elements is a non-detachable connection with said plurality of segments.

15. A textile garment, comprising:

an individual element of a textile material;

a plurality of segments of material being placed contiguously to one another on said individual element with adjacent segments of said plurality of segments being formed with complementary shapes to one another;

means for connecting said plurality of segments to said individual element, and, means for connecting individual elements to one another at their edges.

16. The textile garment according to claim 15, wherein individual segments of said plurality of segments have different shapes from one another.

17. The textile garment according to claim 15, wherein individual segments of said plurality of segments have different sizes from one another.

18. The textile garment according to claim 15, wherein individual segments of said plurality of segments have different patterns from one another.

19. The textile garment according to claim 15, wherein individual segments of said plurality of segments are made of different materials from one another.

20. The textile garment according to claim 15, wherein individual segments of said plurality of segments have different shapes from one another.

21. A kit for permitting a wearer of a textile clothing article to pattern designs on an outer surface of said textile clothing article, said kit comprising:

loosely packaged individual elements of material with each of said individual elements having a given shape, said given shape of one of said individual elements being either the same or different from one or more other said individual elements;

a plurality of segments of material being placed on at least one of said individual elements, with adjacent segments of said plurality of segments being formed with complementary shapes to one another, said plurality of segments being loosely packaged with said individual elements;

means for permitting the wearer of said clothing article to connect said loosely packaged individual elements to said clothing article;

means for permitting the wearer to said clothing article to connect said plurality of segments to at least one of said individual elements of said plurality of individual elements; and, means for connecting individual elements to one another at their edges.

* * * * *